US005787324A

United States Patent [19]

Iwasaki

[11] Patent Number: 5,787,324

[45] Date of Patent: Jul. 28, 1998

[54] IMAGE FORMING APPARATUS HAVING A PLURALITY OF VERTICALLY STACKED IMAGE FORMING UNITS

[75] Inventor: Takeo Iwasaki, Nagoya, Japan

[73] Assignee: Brother Kogyo Kabushiki Kaisha, Nagoya, Japan

[21] Appl. No.: 718,864

[22] Filed: Sep. 24, 1996

[30] Foreign Application Priority Data

Nov. 17, 1995 [JP] Japan ..... 7-300314

[51] Int. Cl.[6] ..... G03G 21/00

[52] U.S. Cl. ..... 399/112; 347/245; 399/124; 399/223

[58] Field of Search ..... 399/112, 113, 399/114, 119, 124, 179, 226, 223; 347/245, 263

[56] References Cited

U.S. PATENT DOCUMENTS

| | | | |
|---|---|---|---|
| 5,047,801 | 9/1991 | Haneda et al. | 399/112 |
| 5,253,028 | 10/1993 | Gonda et al. | 399/124 |
| 5,282,012 | 1/1994 | Terada et al. | 399/112 |
| 5,517,296 | 5/1996 | Choi et al. | 399/226 |

*Primary Examiner*—Nestor R. Ramirez
*Attorney, Agent, or Firm*—Oliff & Berridge,P.L.C.

[57] ABSTRACT

Maintenance performance is promoted and a vivid printed image is provided in an electrophotographic device capable of conducting color printing. Cartridges corresponding to different printing colors, each of which includes a photosensitive body, are stacked in a vertical direction. A recording sheet is fed along a sheet feeding path and brought into contact with the photosensitive bodies corresponding to the respective colors, and toner images of the respective printing colors are transferred on the recording sheet. A transfer belt for feeding the recording sheet is arranged in a front cover, and the transfer belt is exposed when the front cover is opened. Therefore, correcting a mis-feeding of the recording sheet is facilitated. Also, the respective cartridges are spaced apart such that optical paths are provided between the cartridges so that optical beams corresponding to the respective printing colors may be directly irradiated onto the corresponding photosensitive bodies. In addition, the cartridges and optical scanners are mounted on the device using materials having substantially the same coefficient of thermal expansion so that changes in the ambient temperature will not affect the relative positions of the scanners and the photosensitive bodies.

21 Claims, 2 Drawing Sheets

S

IMAGE FORMING APPARATUS HAVING A PLURALITY OF VERTICALLY STACKED IMAGE FORMING UNITS

BACKGROUND OF THE INVENTION

1. Field of the Invention

The present invention relates to an electrophotographic device for carrying out so-called color printing, using two or more printing colors, based on information input from a computer or the like.

2. Description of Related Art

Conventionally, in electrophotographic devices such as printers for performing color printing, information sent from external computers and the like are divided into respective printing colors of black, yellow, magenta and cyan. Individual optical beams are modulated in accordance with respective color printing information, and the optical beams are irradiated onto corresponding photosensitive bodies, whereby electrostatic latent images corresponding to the color printing information are formed on the photosensitive bodies. Toners of the respective printing colors, which have been previously electrically charged to a polarity reverse to that of the photosensitive bodies, are then adhered to the photosensitive bodies on which the latent images have been formed to form toner images on the photosensitive bodies. Next, transferring operations are conducted by successively bringing a recording sheet in contact with the faces of the photosensitive bodies on which the toner images have been formed. Finally a color image formed by the overlapping printing colors is outputted.

In a conventional electrophotographic device having the above-mentioned structure, developing units, such as cartridges including the respective photosensitive bodies and toners, are arranged in parallel with the horizontal direction. Typically, the photosensitive bodies are disposed at lower portions of the cartridges. Optical beams are directed toward the photosensitive bodies by deflecting devices such as reflecting mirrors, such that the optical beams irradiate the photosensitive bodies to form the electrostatic latent images.

Typically, the recording sheet is successively brought into contact with the faces of the photosensitive bodies using a transfer belt so that toner images formed on the respective photosensitive bodies are transferred to the recording paper.

Maintenance of the above-mentioned conventional electrophotographic device is accomplished by drawing out the respective developing units in the horizontal direction. This may be done to perform corrective maintenance, or to replenish toner.

In the above-mentioned electrophotographic device of the conventional technology, the transfer belt is typically arranged below the respective developing units. Therefore, when misfeeding of the recording sheet occurs, it is necessary to open and close all of the developing units to clear the recording sheet feeding path. Because the mechanism including all the developing units is very heavy, convenience in the opening and closing operation is poor and the maintenance performance is also poor.

In an electrophotographic device of the conventional technology, the photosensitive bodies, which must be irradiated with the optical beams, are supported at the lower portions of the developing units. For this reason, it is often necessary to reflect optical beams used to expose the photosensitive bodies using complicated mechanisms such as reflecting mirrors to irradiate the optical beams on the photosensitive bodies. As a result, the structure of the electrophotographic device is complicated.

Further, the positions of the reflecting mirrors, etc. used for reflecting the optical beams may be deformed due to heat generated by members of a fixing unit and the like. Because the positions of the reflecting mirrors for irradiating the optical beams on the photosensitive bodies vary with temperature variations, the image recording positions on the photosensitive bodies also vary. As a result, a shifting of color images may occur and the sharpness of the resulting color image is deteriorated.

Furthermore, because the developing units are drawn out in the horizontal direction to perform maintenance, a space surrounding the device must be maintained to facilitate maintenance. As a result, the degree of freedom for arranging the electrophotographic device is lowered.

SUMMARY OF THE INVENTION

The present invention has been carried out in view of the above-mentioned respective problems and it is an object of the present invention to provide an electrophotographic device capable of conducting color printing, promoting the performance of maintenance and obtaining a vivid printed image.

In order to solve the above-mentioned problems, and according to a first aspect of the present invention, an electrophotographic device embodying the invention includes a main body frame including, at the inner portion thereof, a plurality of developing means. Each developing means may include a cartridge, each cartridge including a photosensitive body corresponding to one of the printing colors of black, magenta, yellow and cyan. The device further includes supporting members supporting the plurality of developing means such that respective ones of the photosensitive bodies are arranged in a vertical direction. A pivotally openable and closable door, such as a front cover, includes recording sheet feeding means at the inner side thereof. The recording sheet feeding means, such as a transfer belt, brings a recording sheet successively in contact with faces of the respective photosensitive bodies while the recording paper moves in the vertical direction.

According to a second aspect of the present invention, the electrophotographic device may include supporting members that support the plurality of developing means such that the photosensitive faces are aligned along the same vertical plane. In addition, the door may be openable and closable by pivoting the door about a shaft oriented parallel to the vertical direction. Accordingly, even if misfeeding of a recording sheet occurs, the feeding path of the recording sheet can be fully exposed to a user and the misfed recording sheet can be easily removed. Therefore, the performance of maintenance in the electrophotographic device is promoted.

According to a third aspect of the present invention, an electrophotographic device embodying the invention includes a main body frame having, at an inner portion thereof, a plurality of emitting means such as scanners, each emitting an optical beam toward a corresponding photosensitive face. The optical beams are modulated based on information corresponding to the respective printing colors input from an external device. The developing means are arranged such that the respective optical beams are irradiated directly onto the corresponding respective photosensitive bodies from the emitting means.

According to a fourth aspect of the present invention, an electrophotographic device embodying the invention includes supporting members that include photosensitive body supporting members for supporting the photosensitive bodies such that the respective photosensitive faces are arranged along the same vertical plane and such that the developing means are arranged stacked, one on top of another, in the vertical direction. With this arrangement, the developing means can be easily taken in and out of the top of the device. The developing means supporting members also support the developing means such that the optical paths of the optical beams are not blocked.

According to a fifth aspect of the present invention, an electrophotographic device embodying the invention includes emitting means supporting members for supporting the plurality of emitting means such that they are also stacked, one on top of another, in the vertical direction. The device further includes photosensitive body supporting members and emitting means supporting members that are formed of the same materials, such as stainless steel, having the same coefficient of thermal expansion. Accordingly, the positional relationships between the emitting means and the photosensitive bodies do not vary, even if the electrophotographic device is heated. Therefore, the positions of irradiating the optical beams on the photosensitive bodies do not vary and a vivid transfer image is provided.

According to a sixth aspect of the present invention, an electrophotographic device embodying the invention includes a plurality of developing means that are arranged such that the developing means corresponding to the most frequently used color is disposed at the uppermost portion. Accordingly, the performance of maintenance in interchanging the developing means etc. is promoted.

According to a seventh aspect of the present invention, an electrophotographic device embodying the invention has a developing means corresponding to the color black, which is the most frequently used printing color, arranged at the uppermost portion. Accordingly, the performance of maintenance in interchanging the developing means, etc. is promoted.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

Next, an explanation will be given of a preferred embodiment of the present invention with reference to FIG. 1 and FIG. 2.

Figure 1:
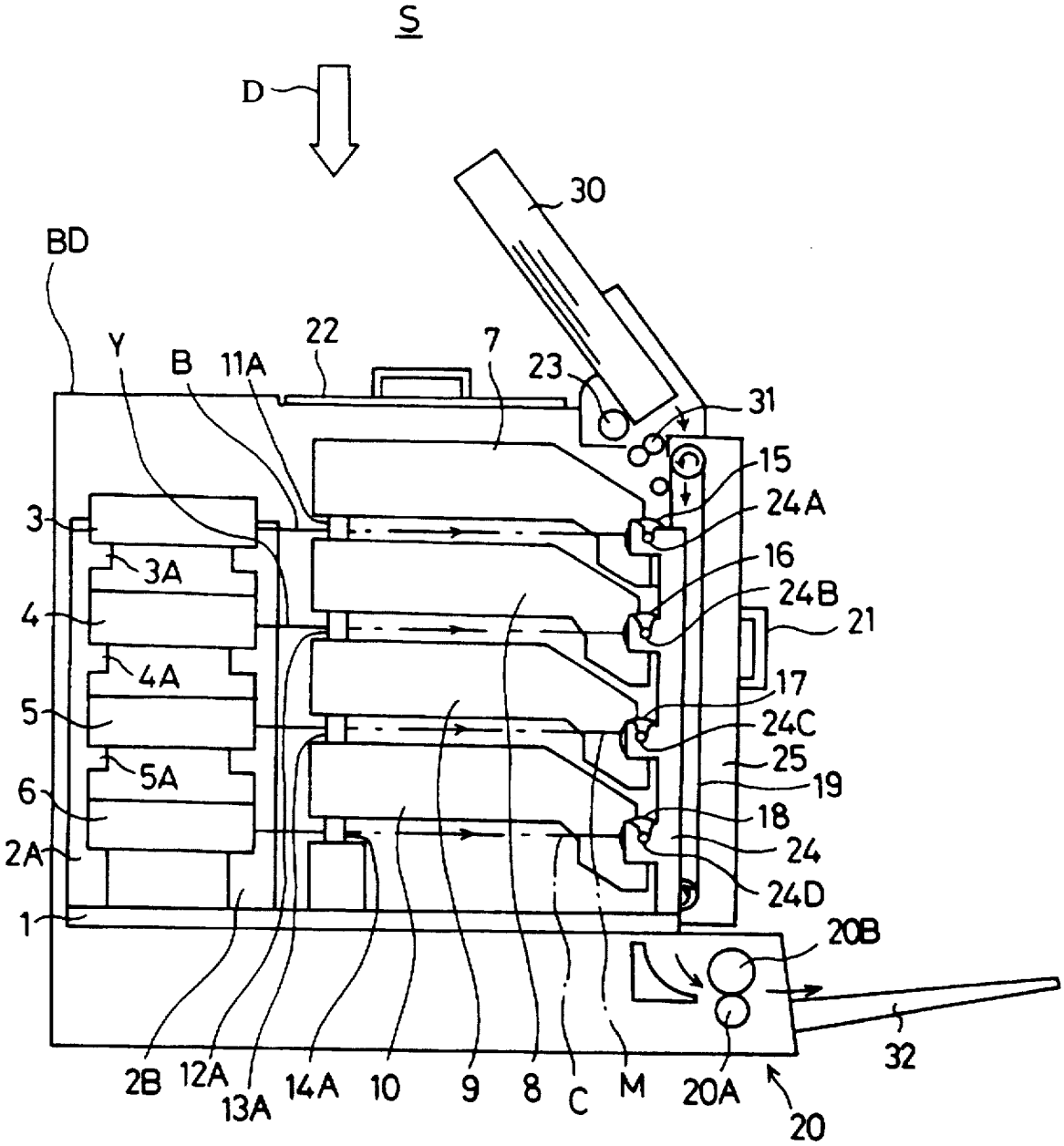
FIG. 1 is a side view showing the inner mechanism of an embodiment of an electrophotographic device.
Figure 2:
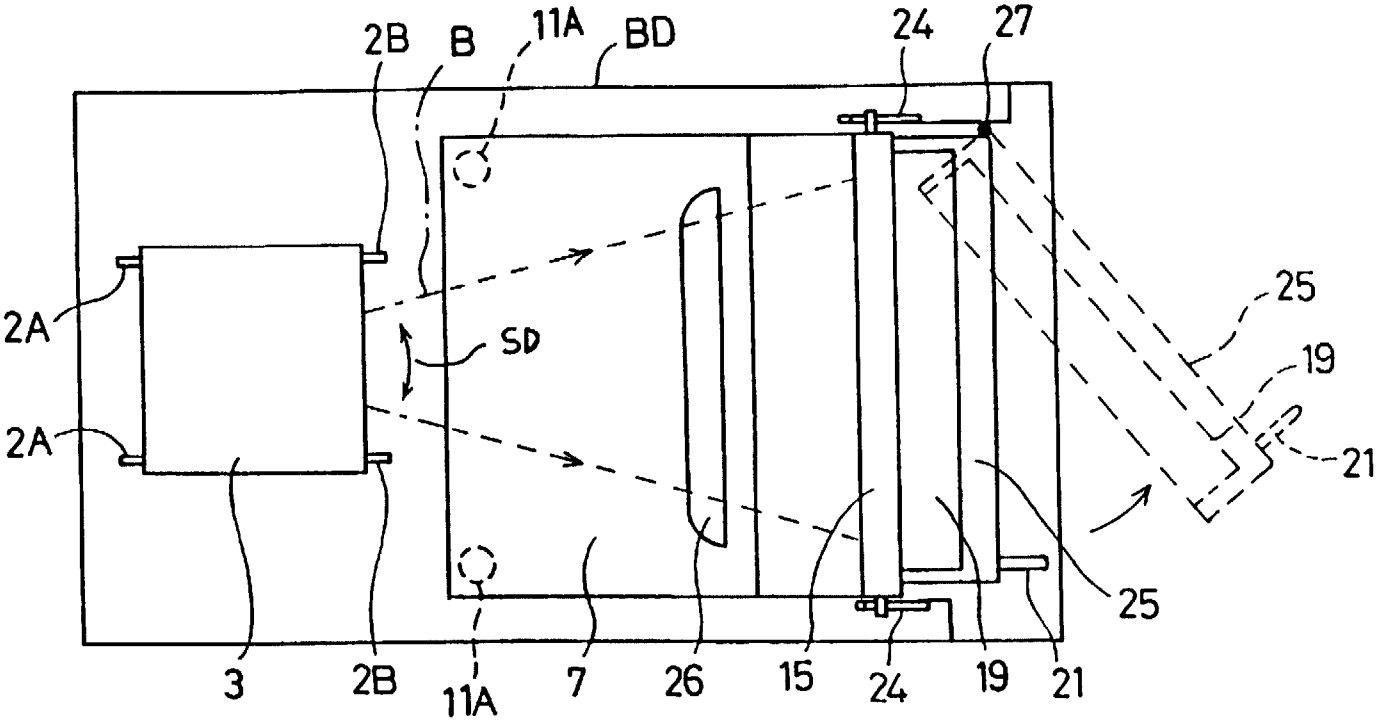
FIG. 2 is a top plan view showing the inner mechanism of the electrophotographic device of FIG. 1 as seen along the direction indicated by the arrow D in FIG. 1.

As shown by FIG. 1 and FIG. 2, the electrophotographic device S is provided with a base plate 1 at the lower portion of a main body frame BD. At the upper portion thereof, a pair of scanner supporting members 2A and 2B support respective scanner units. As shown by FIG. 1, the scanner supporting members 2A and 2B are formed such that they have a plurality of opposed notches 3A, 4A, and 5A arranged vertically. A black scanner 3, a yellow scanner 4, a magenta scanner 5 and a cyan scanner 6 are mounted at the notches, in this order, from the top. The distance between the respective scanners is determined by the distance between the notches 3A, 4A and 5A in the scanner supporting members 2A and 2B. Each scanner is provided with a known structure in which a laser beam emitted from a laser diode is scanned in the horizontal direction by a polygonal mirror.

A black cartridge 7, a yellow cartridge 8, a magenta cartridge 9 and a cyan cartridge 10 are also mounted on the main body frame in the vertical direction, in this order, from the top. The cartridges are arranged at predetermined intervals in the progressing directions of the laser beams emitted from the respective scanners. The black cartridge 7 contains a black toner at an inner portion thereof and it holds a black photosensitive body 15 for developing and transferring a black toner image. The laser beam B emitted from the black scanner 3 is directly incident on the black photosensitive body 15 while the beam B is swept in the horizontal direction. The beam B forms an electrostatic latent image corresponding to the black image.

Similarly, the yellow cartridge 8 contains a yellow toner at an inner portion thereof, and it holds a yellow photosensitive body 16 for developing and transferring a yellow toner image. The laser beam Y emitted from the yellow scanner 4 is directly incident on the yellow photosensitive body 16 while being swept in the horizontal direction. The laser beam Y forms an electrostatic latent image corresponding to the yellow image. The magenta cartridge 9 contains a magenta toner at an inner portion thereof, and it holds a magenta photosensitive body 17 for developing and transferring a magenta toner image. The laser beam M emitted from the magenta scanner 5 is directly incident on the magenta photosensitive body 17 while being swept in the horizontal direction. The laser beam M forms an electrostatic latent image corresponding to the magenta image. The cyan cartridge 10 contains a cyan toner at an inner portion thereof, and it holds a cyan photosensitive body 18 for developing and transferring a cyan toner image. The laser beam C emitted from the cyan scanner 6 is directly incident on the cyan photosensitive body 18 while being swept in the horizontal direction. The laser beam C forms an electrostatic latent image corresponding to the cyan image.

Further, as shown by FIG. 1 and FIG. 2, in order to maintain the spacing between the respective cartridges, cylindrical cartridge supporting members 11A, 12A, 13A and 14A are fixed at lower portions of the respective cartridges opposite the photosensitive bodies. Also, a pair of photosensitive body supporting members 24 having notches 24A, 24B, 24C and 24D which open towards the top, are arranged to receive the shafts of the respective photosensitive bodies. The pair of photosensitive body supporting members 24 and the above-mentioned scanner supporting members 2A and 2B are preferably formed of materials having the same coefficient of thermal expansion. For instance, stainless steel or galvanized steel may be used to form these support members.

When the cyan cartridge 10 is mounted at the lowermost portion of the electrophotographic device S, the shafts of the cyan photosensitive body 18 are supported by the notches 24D of the photosensitive body supporting members 24. Further, a predetermined spacing is formed between the cyan cartridge 10 and the base plate 1 by the cartridge supporting members 14A. In addition, the cartridge supporting members 14A are also spaced apart from each other by a predetermined distance. As a result, a laser beam C emitted from the cyan scanner 6 may be directly incident on the cyan photosensitive body 18 via an optical path passing between the cartridge supporting members 14A, the base plate 1 and the cyan cartridge 10.

When the magenta cartridge 9 is mounted above the cyan cartridge 10, the shafts of the magenta photosensitive body 17 are supported by the notches 24C of the photosensitive body supporting members 24. A predetermined spacing is formed between the magenta cartridge 9 and the cyan cartridge 10 by the cartridge supporting members 13A. In addition, the cartridge supporting members 13A are spaced apart from each other by a predetermined distance. As a result, a laser beam M emitted from the magenta scanner 5 may be directly incident on the magenta photosensitive body 17 via an optical path passing between the cartridge supporting members 13A, the cyan cartridge 10 and the magenta cartridge 9.

When the yellow cartridge 8 is mounted above the magenta cartridge 9, the shafts of the yellow photosensitive body 16 are supported by the notches 24B of the photosensitive body supporting members 24. Further, a predetermined spacing is formed between the yellow cartridge 8 and the magenta cartridge 9 by the cartridge supporting members 12A. In addition, the cartridge supporting members 12A are spaced apart from each other by a predetermined distance. As a result, a laser beam Y emitted from the yellow scanner 4 may be directly incident on the yellow photosensitive body 16 via an optical path passing between the cartridge supporting members 12A, the magenta cartridge 9 and the yellow cartridge 8.

When the black cartridge 7 is mounted above the yellow cartridge 8, the shafts of the black photosensitive body 15 are supported by the notches 24A of the photosensitive supporting members 24. Further, a predetermined spacing is formed between the black cartridge 7 and the yellow cartridge 8 by the cartridge supporting members 11A. In addition, the cartridge supporting members 11A are spaced apart from each other by a predetermined distance. As a result, a laser beam B emitted from the black scanner 3 may be directly incident on the black photosensitive body 15 via an optical path passing between the cartridge supporting members 11A, the yellow cartridge 8 and the black cartridge 7.

When the respective cartridges 7, 8, 9 and 10 are mounted in this way, the respective photosensitive bodies 15, 16, 17 and 18 are aligned in the vertical direction, as illustrated in FIG. 1.

A transfer belt 19 is arranged to feed a recording sheet from the upper portion of the device to a lower portion. A power source (not shown) is also provided to apply a charge to the transfer belt and to a recording sheet being fed by the transfer belt. As the recording sheet passes the photosensitive bodies, toner images of the respective colors formed on the respective photosensitive bodies 15, 16, 17 and 18 are transferred onto the recording sheet. The transfer belt 19 is attached to a front cover 25, which is pivotable about an opening and closing shaft 27 installed on the main body BD. Therefore, as illustrated in FIG. 2, the front cover 25 may be opened by pulling a handle 21 installed on the front cover 25. When the front cover 25 is opened, a paper feed path formed between the transfer belt 19 and the respective photosensitive bodies 15, 16, 17 and 18 is fully exposed.

A feeding cassette 30 for holding recording sheets is detachably installed on the main body frame BD. A pick-up roller 23 for pulling a recording sheet out of the feeding cassette 30, and feed rollers 31 for transferring the recording sheet to the transfer belt 19, are provided at the upper portion of the transfer belt 19.

A known fixing device 20 comprising a heat roller 20A and a pressure roller 20B are provided at the lower portion of the device. The fixing device 20 fixes the toner images transferred from the respective photosensitive bodies 15, 16, 17 and 18, to the recording sheet. In addition, a paper discharging tray 32, for receiving a recording sheet, may be provided adjacent the lower portion of the transfer belt 19.

An upper lid 22 for opening the upper portion of the main body frame BD is provided on the upper face of the main body frame BD such that the respective cartridges 7, 8, 9 and 10 can be mounted from the upper portion of the electrophotographic device S, as described above. A cartridge handle 26 is installed on an upper portion of each of the cartridges 7, 8, 9 and 10, as illustrated in FIG. 2, so that the cartridges can be easily drawn out from the upper side of the device to replenish toner or for maintenance.

Next, an explanation will be given of the operation and advantages of an electrophotographic device S embodying the invention.

Information to be outputted in the form of color printing, which is input from a host computer (not shown), is divided into information for the respective printing colors in a printing controller (also not shown). The respective information for the respective printing colors is input to the black scanner 3, the yellow scanner 4, the magenta scanner 5 and the cyan scanner 6. Optical beams B, Y, M and C, corresponding to the respective colors, are output from laser diodes contained in the respective scanners 3, 4, 5 and 6 in accordance with the information for the respective printing colors. The optical beams B, Y, M and C are scanned across the respective photosensitive bodies 15, 16, 17 and 18 in a horizontal direction, as shown by arrow SD in FIG. 2, by polygonal mirrors contained in the respective scanners 3, 4, 5 and 6.

The respective optical beams B, Y, M and C irradiate the respective photosensitive bodies 15, 16, 17 and 18, as each of the photosensitive bodies 15, 16, 17 and 18 rotates, to develop electrostatic latent images corresponding to the printing information for the respective printing colors. Specifically, an electrostatic latent image corresponding to the black printing information is formed on the black photosensitive body 15 by the optical beam B, which is modulated based on the black printing information. Similarly, an electrostatic latent image corresponding to the yellow printing information is formed on the yellow photosensitive body 16, an electrostatic latent image corresponding to the magenta printing information is formed on the magenta photosensitive body 17, and an electrostatic latent image corresponding to the cyan printing information is formed on the cyan photosensitive body 18.

Colored toners, which are stored in the respective cartridges 7, 8, 9 and 10 and which are charged to a polarity reverse to that of the respective photosensitive bodies 15, 16, 17 and 18, are adhered to portions of the respective photosensitive bodies where the electrostatic latent images have been formed.

Meanwhile, a recording sheet fed from the paper feeding cassette 30 by the pick-up roller 23 and the feed rollers 31, is fed from the upper portion to the lower portion of the device by the transfer belt 19. During the sheet feeding, the recording sheet is brought into contact with the photosensitive bodies 15, 16, 17 and 18, which carry the developed toner images of the respective printing colors, and the respective toner images are transferred onto the recording sheet. The color toner images are fixed to the recording sheet by the fixing unit 20, and the recording sheet is output to the paper discharging tray 32.

As mentioned above, the front cover 25 may be opened by pulling the handle 21 to rotate the front cover 25 about the shaft 27, as illustrated by the broken lines in FIG. 2. Because the transfer belt 19 is installed at an inner side of the front cover 25, the sheet feeding path of the recording sheet, which is formed between the transfer belt 19 and the photosensitive bodies 15, 16, 17 and 18, is fully exposed when the front cover 25 is opened. Therefore, even if mis-feeding of a recording sheet occurs, the feeding path of the recording sheet can be easily exposed by opening the front cover 25, and removal of a mis-fed recording sheet is facilitated.

The transmission of rotational power to the transfer belt 19 is carried out by gears, not shown, installed in the front cover 25 and the main body frame BD.

When the respective rotating shafts of the respective photosensitive bodies 15, 16, 17 and 18 are held by the notches 24A, 24B, 24C and 24D that are formed in the photosensitive body supporting members 24, the respective photosensitive faces thereof are disposed along the same vertical plane. The photosensitive body supporting members 24 are formed of a material having a coefficient of thermal expansion that is substantially the same as that of the above-mentioned scanner supporting members 2A and 2B. Both the scanner supporting members 2A and 2B and the photosensitive body supporting members 24 are fixed to the main body frame BD via the base plate 1. Therefore, even if the electrophotographic device S is heated by heat generated from the fixer 20 or outside air, the corresponding positional relationships between the scanners 3, 4, 5 and 6 and the photosensitive bodies 15, 16, 17 and 18 do not vary. Accordingly, the positions at which the optical beams B, Y, M and C are irradiated onto the corresponding photosensitive bodies 15, 16, 17 and 18, do not vary, and the toner transfer positions of the respective colors do not shift. Accordingly, a vivid transfer image can be obtained.

The respective cartridges 7, 8, 9 and 10 are supported at predetermined spacings by providing the substantially cylindrical cartridge supporting members 11A, 12A, 13A and 14A. The cartridge supporting members 11A, 12A, 13A and 14A are provided out of scanning ranges of the respective optical beams B, Y, M and C, as shown by FIG. 2. In this arrangement, the optical beams B, Y, M and C can be directly irradiated onto the corresponding photosensitive bodies 15, 16, 17 and 18. Therefore, deflectors, such as reflecting mirrors, are not necessary, and the structure of the electrophotographic device S can be simplified.

The black cartridge 7 having the highest frequency of toner use (in other words, the most frequently used and replaced toner) is arranged at the uppermost portion. Therefore, the black cartridge 7 can easily taken out to replace the toner, the entire cartridge, or to perform maintenance. Furthermore, the yellow cartridge 8, the magenta cartridge 9 and the cyan cartridge 10 are arranged from the top, down, in the order of the frequency of use, thus the maintenance is further facilitated.

Although the invention has been described with reference to a color printer, the present invention is not limited thereto and is applicable to a color facsimile machine, a color copier and the like.

While the present invention has been described with reference to what is presently considered to be a preferred embodiment, it is to be understood that the invention is not limited to the disclosed embodiment. On the contrary, the invention is intended to cover various modifications and equivalent arrangements included within the spirit and scope of the appended claims.

What is claimed is:

1. An electrophotographic device, comprising:

a main body frame;

a plurality of developing devices, each developing device including a developing material storage bin, an optical beam emitter and a photosensitive member, wherein developing material is provided from the storage bin to a surface of the photosensitive member to form developing material images on the surface of the photosensitive member, such that each developing device holds a different color developing material, and the plurality of optical beam emitters are arranged so each optical beam travels along an optical path passing directly from a beam emitter to a corresponding one of the photosensitive members;

a developer supporting device for supporting the plurality of developing devices on the main body frame;

a door that is openable to expose a recording sheet feeding path of the electrophotographic device; and a recording sheet feeding device mounted on an inner side of the door for feeding a recording sheet along the recording sheet feeding path to successively bring the recording sheet adjacent the photosensitive members of the plurality of developing devices so that developing material on surfaces of the photosensitive members can be transferred to the recording sheet, said recording sheet feeding device feeding said recording sheet across all of the developing devices in a linear manner.

2. An electrophotographic device according to claim 1, wherein the photosensitive members of the plurality of developing devices are arranged in a substantially vertical plane.

3. An electrophotographic device according to claim 2, wherein the door is pivotable about a shaft whose longitudinal axis is parallel to the vertical plane in which the photosensitive members are arranged.

4. An electrophotographic device according to claim 1, wherein said plurality of optical beam emitters each emits an optical beam that is modulated based on printing information.

5. An electrophotographic device according to claim 4, further comprising a rear supporting device that supports a side of each developing device opposite the photosensitive member such that the optical paths of the plurality of beam emitters may pass directly from the beam emitters to the corresponding photosensitive members.

6. An electrophotographic device according to claim 4, further comprising a vertically oriented beam emitter supporting device for supporting the plurality of beam emitters on the main body frame.

7. An electrophotographic device according to claim 6, wherein the developer supporting device comprises two vertically oriented support frames, and wherein each support frame supports one side of the photosensitive members of the plurality of developing devices.

8. An electrophotographic device according to claim 7, wherein the beam emitter supporting device and the developer supporting device are made from materials having substantially the same coefficient of thermal expansion.

9. An electrophotographic device according to claim 1, wherein the plurality of developing devices are arranged such that they form a vertically extending stack, and wherein the plurality of developing devices are inserted into and removed from the electrophotographic device through a door in the top of the electrophotographic device.

10. An electrophotographic device according to claim 9, wherein the developing device holding the most frequently used color is disposed on top of the stack.

11. An electrophotographic device according to claim 9, wherein the developing device holding black developing material is disposed on top of the stack.

12. An electrophotographic device, comprising:

a main body frame;

a plurality of developing means for forming and transferring a developing material image onto a recording sheet, each developing means including a photosensitive member and beam emission means for emitting an optical beam, such that each developing means holds a different color developing material, and the plurality of beam emission means are arranged so each optical beam travels along an optical path passing directly from a beam emission means to a corresponding one of the photosensitive members;

a developer supporting means for supporting the plurality of developing means on the main body frame;

a door that is openable to expose a recording sheet feeding path of the electrophotographic device; and recording sheet feeding means for feeding a recording sheet along the recording sheet feeding path to successively bring the recording sheet adjacent the photosensitive members of the plurality of developing means so that developing material images on surfaces of the photosensitive members can be transferred to the recording sheet, wherein the recording sheet feeding means is mounted on on an inner side of the door, said recording sheet feeding means feeding said recording sheet across all of the developing means in a linear manner.

13. An electrophotographic device according to claim 12, wherein the photosensitive members of the plurality of developing means are arranged in a substantially vertical plane.

14. An electrophotographic device according to claim 13, wherein the door is pivotable about a shaft whose longitudinal axis is parallel to the vertical plane in which the photosensitive members are arranged.

15. An electrophotographic device according to claim 12, wherein said optical beams are modulated based on printing information, and wherein each emission means is capable of scanning its emitted optical beam in a substantially horizontal direction across a corresponding one of the photosensitive members.

16. An electrophotographic device according to claim 15, further comprising rear supporting means for supporting a side of each developing means opposite the photosensitive member such that the rear supporting means does not interfere with the optical beams emitted by the plurality of emission means as each emission means scans its optical beam across a corresponding one of the photosensitive members.

17. An electrophotographic device according to claim 15, further comprising vertically oriented beam emitter supporting means for supporting the plurality of beam emission means on the main body frame.

18. An electrophotographic device according to claim 17, wherein the beam emitter supporting means and the developer supporting means maintain the positional relationships of the photosensitive members and the beam emission means regardless of temperature variations.

19. An electrophotographic device according to claim 12, wherein the plurality of developing means are arranged such that they form a vertically extending stack, and wherein the plurality of developing means are inserted into and removed from the electrophotographic device through a door in the top of the electrophotographic device.

20. An electrophotographic device according to claim 19, wherein the developing means holding the most frequently used color is disposed on top of the stack.

21. An electrophotographic device according to claim 19, wherein a developing means holding black developing material is disposed on top of the stack.

* * * * *